US009305523B2

(12) United States Patent
Shin

(10) Patent No.: US 9,305,523 B2
(45) Date of Patent: Apr. 5, 2016

(54) METHOD OF EDITING CONTENTS AND AN ELECTRONIC DEVICE THEREFOR

(71) Applicant: Samsung Electronics Co., Ltd., Gyeonggi-do (KR)

(72) Inventor: Sang-Min Shin, Gyeonggi-do (KR)

(73) Assignee: Samsung Electronics Co., Ltd., Samsung-ro, Yeongtong-gu, Suwon-si, Gyeonggi-do (KR)

( * ) Notice: Subject to any disclaimer, the term of this patent is extended or adjusted under 35 U.S.C. 154(b) by 378 days.

(21) Appl. No.: 13/904,427

(22) Filed: May 29, 2013

(65) Prior Publication Data

US 2013/0342566 A1 Dec. 26, 2013

(30) Foreign Application Priority Data

Jun. 22, 2012 (KR) ..... 10-2012-0067199

(51) Int. Cl.

| | |
|---|---|
| ***G09G 5/00*** | (2006.01) |
| ***G09G 5/377*** | (2006.01) |
| ***G09G 5/14*** | (2006.01) |

(52) U.S. Cl.

CPC ..... *G09G 5/377* (2013.01); *G09G 5/14* (2013.01); *G09G 2340/12* (2013.01); *G09G 2354/00* (2013.01)

(58) Field of Classification Search

None

See application file for complete search history.

(56) References Cited

U.S. PATENT DOCUMENTS

| | | | | |
|---|---|---|---|---|
| 5,459,819 | A * | 10/1995 | Watkins et al. | 358/1.18 |
| 5,986,671 | A * | 11/1999 | Fredlund et al. | 345/629 |
| 6,985,161 | B1 * | 1/2006 | Politis | 345/629 |
| 7,336,277 | B1 * | 2/2008 | Clark et al. | 345/426 |
| 8,698,840 | B2 * | 4/2014 | Yeh et al. | 345/629 |
| 8,743,136 | B2 * | 6/2014 | Besley | 345/592 |
| 2001/0017630 | A1 * | 8/2001 | Sakashita et al. | 345/635 |
| 2006/0066638 | A1 * | 3/2006 | Gyde et al. | 345/635 |
| 2010/0079492 | A1 * | 4/2010 | Nakamura | 345/634 |
| 2010/0149557 | A1 * | 6/2010 | Naruse | 358/1.6 |
| 2010/0169865 | A1 * | 7/2010 | Clemm | 717/121 |
| 2010/0245868 | A1 * | 9/2010 | Wade et al. | 358/1.9 |
| 2011/0307448 | A1 * | 12/2011 | Tanaka et al. | 707/641 |
| 2011/0314840 | A1 | 12/2011 | Jahangiri-Famenini | |
| 2011/0316655 | A1 | 12/2011 | Mehraban et al. | |
| 2011/0316699 | A1 | 12/2011 | Arunachalam | |
| 2011/0316784 | A1 | 12/2011 | Bisutti et al. | |
| 2011/0320395 | A1 | 12/2011 | Dada et al. | |
| 2011/0320978 | A1 | 12/2011 | Horodezky et al. | |
| 2012/0001854 | A1 | 1/2012 | Tikkanen | |
| 2012/0004012 | A1 | 1/2012 | Hamblin et al. | |
| 2012/0005595 | A1 * | 1/2012 | Gavade et al. | 715/751 |
| 2012/0005622 | A1 | 1/2012 | Park et al. | |
| 2012/0007726 | A1 | 1/2012 | Yang et al. | |

(Continued)

FOREIGN PATENT DOCUMENTS

| | | | |
|---|---|---|---|
| KR | 10-2009-0055982 | A | 6/2009 |
| KR | 10-2011-0124777 | A | 11/2011 |

*Primary Examiner* — Ryan R Yang

(74) *Attorney, Agent, or Firm* — Cha & Reiter, LLC.

(57) ABSTRACT

Methods for editing contents in a touch screen electronic device are provided. One method detects user selection of a plurality of displayed contents to be combined within one contents region, such as a memo. Main contents and sub-contents are determined from the selected contents, based on a predetermined input gesture. The sub-contents are combined with the main contents, where a style of the sub-contents is automatically changed to a style of the main contents. Techniques for separating combined contents are also disclosed.

20 Claims, 15 Drawing Sheets

(56) References Cited

U.S. PATENT DOCUMENTS

| | | | |
|---|---|---|---|
| 2012/0007811 | A1 | 1/2012 | Peng |
| 2012/0007816 | A1 | 1/2012 | Lin et al. |
| 2012/0007822 | A1 | 1/2012 | Luo |
| 2012/0007835 | A1 | 1/2012 | Chang et al. |
| 2012/0013533 | A1 | 1/2012 | Chien et al. |
| 2012/0013569 | A1 | 1/2012 | Swedin |
| 2012/0015334 | A1 | 1/2012 | Hamilton |
| 2012/0015621 | A1 | 1/2012 | Cerny et al. |
| 2012/0015721 | A1 | 1/2012 | Colbert-Carr et al. |
| 2012/0017161 | A1 | 1/2012 | Hirshberg |
| 2012/0092374 | A1* | 4/2012 | Sarnoff ..... 345/634 |
| 2012/0210294 | A1* | 8/2012 | Gores ..... 717/105 |
| 2013/0107585 | A1* | 5/2013 | Sims et al. ..... 363/21.14 |
| 2014/0156801 | A1* | 6/2014 | Fernandes et al. ..... 709/219 |
| 2014/0181935 | A1* | 6/2014 | Beckmann et al. ..... 726/7 |

* cited by examiner

METHOD OF EDITING CONTENTS AND AN ELECTRONIC DEVICE THEREFOR

CLAIM OF PRIORITY

This application claims the benefit under 35 U.S.C. §119 (a) of a Korean patent application filed in the Korean Intellectual Property Office on Jun. 22, 2012 and assigned Serial No. 10-2012-0067199, the entire disclosure of which is hereby incorporated by reference.

BACKGROUND

1. Technical Field

The present disclosure relates to an electronic device for editing previously stored contents. More particularly, the present disclosure relates to apparatus and methods for combining or dividing contents in an electronic device.

2. Description of the Related Art

Today'subiquitous portable electronic devices such as smart phones, tablet PCs, personal digital assistants (PDAs), and so forth, have developed into multimedia devices capable of providing various multimedia functions. These include voice and video communications, music storage and playback, web surfing, photography, note taking, texting, information input/output, data storage, etc.

An amount of information processed and displayed according to the provision of the multimedia services has been on the rise in mainstream devices. Accordingly, there is a growing interest in devices which has a touch screen capable of improving space utilization and increasing a size of a display unit thereof.

As is well known, the touch screen is an input and display device for inputting and displaying information on a screen. An electronic device including a touch screen may have a larger display size by removing a separate input device such as a keypad and using substantially the entire front surface of the device as a screen.

Trends in recent devices have been to increase the size of the touch screen and to provide functions allowing a user to write text and draw lines using input tools such as a stylus pen and an electronic pen. For example, in a memo function, the device senses input of the user, receives texts, curves, straight lines, etc., and stores the inputted information in a memo file with a corresponding file name. Subsequently, the user may open a previously stored memo file and verify texts stored in the memo file. Other multimedia items can be stored in a memo file as well, such as still images, audio files and video files.

Memo files can be managed and edited, e.g., by combining memo files of different contents, moving contents of one file to another, or creating new memo files. To this end, the user performs a process of copying and pasting the contents stored in one memo file to an existing memo file or to be newly stored in a new file.

This process is performed by opening a memo file and repeating a copy and paste process, which can be time consuming and tedious to the user.

Accordingly, there is a need for a simpler, more efficient and user friendly memo editing function to be implemented in today's portable devices.

SUMMARY

An aspect of the present invention is to provide an apparatus and method for improving performance of a contents editing process in an electronic device.

Embodiments disclosed herein combine a plurality of contents into one contents in an electronic device. Other embodiments divide one contents into a plurality of contents in an electronic device.

In embodiments, a style of contents may be automatically changed when editing the contents in an electronic device.

In an embodiment, a method of editing contents in an electronic device is provided. The method detects user selection of a plurality of displayed contents to be combined. Main contents and sub-contents are determined from the selected contents, based on a predetermined input gesture. The sub-contents are combined with the main contents, where a style of the sub-contents is automatically changed to a style of the main contents. In an embodiment, an electronic device for editing contents includes at least one processor and a memory storing at least one program configured to be executable by at least the one processor. The program includes instructions for detecting selection of a plurality of displayed contents to be combined, defining main contents and sub-contents from the selected contents, and combining the sub-contents with the main contents, where a style of the sub-contents is automatically changed to a style of the main contents.

In accordance with an aspect, a non-transient computer readable medium stores one or more programs including instructions that, when executed by a processor of an electronic device, cause the electronic device to perform the exemplary methods described herein.

BRIEF DESCRIPTION OF THE DRAWINGS

The above and other aspects, features and advantages of certain exemplary embodiments of the present invention will be more apparent from the following detailed description taken in conjunction with the accompanying drawings, in which.

DETAILED DESCRIPTION

Figure 1:
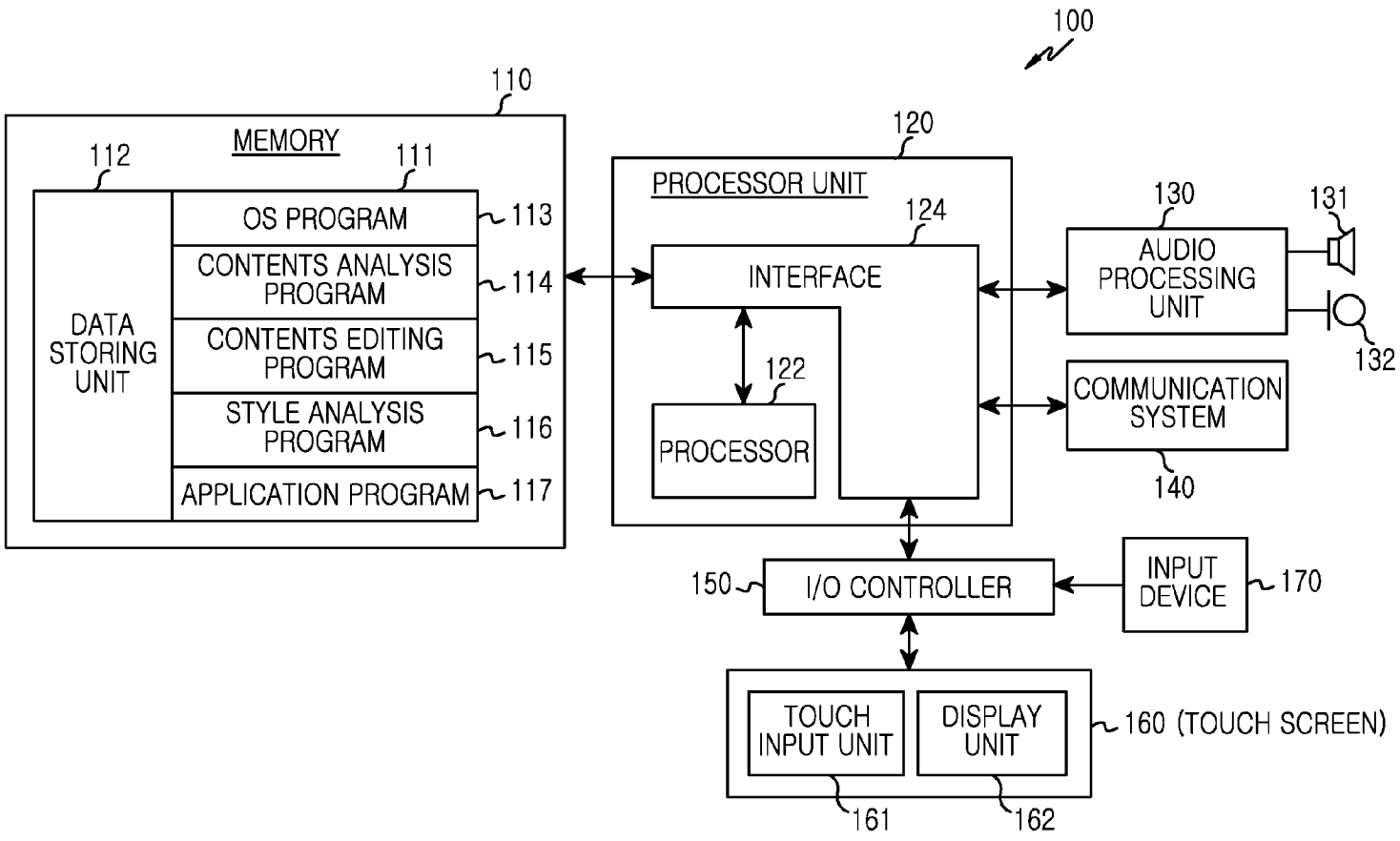
FIG. 1 is a block diagram illustrating configuration of an electronic device for editing contents according to an exemplary embodiment of the present invention.

Exemplary embodiments of the present invention will be described herein below with reference to the accompanying drawings. In the following description, well-known functions or constructions are not described in detail since they would obscure the invention in unnecessary detail.

Hereinafter, a description will be given for an apparatus and method for editing previously stored contents in an electronic device according to exemplary embodiments of the present invention. Herein, "contents" are digital data items capable of being reproduced, displayed or executed using the electronic device. Contents may include multimedia data items (e.g., jpg data items, mp3 data items, avi data items, mmf data items, etc.) and text data items (e.g., pdf data items, doc data items, hwp data items, txt data items, etc.).

As used herein, "contents region" means a display region including a set of contents that appear to be associated with one other. A contents region can be defined by a closed geometrical boundary, a highlighted area, or the like. Examples of a contents region include a text box, a memo and a thumbnail image. A contents region can be dynamically movable on the display, and can have a size that is dynamically changeable.

Herein, the term "one contents" is used to mean the contents of a single contents region. The term "a plurality of contents" is used to refer to contents of different contents regions, where each contents of the plurality of contents either originated from a different contents region in the context of describing a contents combining operation, or, is destined to wind up in a different contents region in the context of describing a contents dividing operation.

To edit contents of a contents region is to combine a plurality of contents of different contents regions into one content region, or dividing one contents into different contents regions. Herein, the edited contents may be contents of different types or contents of the same type. This means that multimedia data items and text data items may be combined into one contents region and text data items may be combined into one contents region.

In accordance with exemplary embodiments, a user input in the form of a gesture (touch pattern) on a touch screen of the electronic device is recognized by the device. A touch is performed on the touch screen of the electronic device by an external input means such as a user's finger or a stylus pen. A gesture can be a drag of a certain pattern performed in a state where the touch is held on the touch screen. In some cases, a gesture is only recognized as an input command when the touch is released after the drag. A single or multi-tap can also be considered a gesture. In some embodiments, e.g., devices configured to receive input with an electronic pen, inputs can be recognized with near touches in addition to physical touches on the touch screen.

An electronic device of the embodiments disclosed herein may be a portable electronic device. The electronic device may any one of apparatuses such as a portable terminal, a mobile phone, a media player, a tablet computer, a handheld computer, a Personal Digital Assistant (PDA), and a multifunction camera. Also, the electronic device may be a certain portable electronic device including a device in which two or more functions are combined among these apparatuses.

FIG. 1 is a block diagram illustrating configuration of an electronic device 100 for editing contents according to one exemplary embodiment of the present invention. Device 100 includes a memory 110, a processor unit 120, an audio processing unit 130, a communication system 140, an Input/Output (I/O) controller 150, a touch screen 160, and an input device 170. Memory 110 and communication system 140 may be a plurality of memories and communication systems, respectively.

The memory 110 includes a program storing unit 111 which stores programs for controlling an operation of the electronic device and a data storing unit 112 which stores data items generated while the programs are performed. For example, the data storing unit 112 stores various rewritable data items, such as phonebook entries, outgoing messages, and incoming messages. Also, the data storing unit 112 stores a plurality of contents according to exemplary embodiments of the present invention. Data storing unit 112 further stores edited contents (e.g., combined contents, divided contents, etc.) according to a user's input.

Program storing unit 111 includes an Operating System (OS) program 113, a contents analysis program 114, a contents editing program 115, a style analysis program 116, and at least one application program 117. Here, the programs included in the program storing unit 111 may be expressed in a set of instructions. Accordingly, the modules are expressed in an instruction set.

The OS program 113 includes several software components for controlling a general system operation. For example, control of this general system operation involves memory management and control, storage hardware (device) control and management, power control and management, etc. This OS program 113 also performs a function for smoothly communicating between several hardware (devices) and program components (modules).

The contents analysis program 114 includes at least one or more software components for determining main contents and sub-contents from edited contents according to a user's input. Here, the main contents and the sub-contents may be classified according to an editing type. In embodiments of the invention, if sub-contents are combined with main contents in a common contents region, a style of the sub-contents is automatically changed to a style of the main contents. Examples for distinguishing main contents from sub-contents and handling the same will be described in detail below.

Further, when the contents are multimedia data items (e.g., jpg data items, mp3 data items, avi data items, mmf data items, etc.), styles of the contents may be a reproduction speed, a screen output size, the number of regeneration (or copying), etc. Thus when multimedia data items of a sub contents region are combined with those of a main contents region, if the reproduction speeds and screen sizes of the original contents differ, those of the sub contents region are changed to conform to the parameters of the main contents region. When the contents are text data items (e.g., pdf data items, doc data items, hwp data items, txt data items, etc.), styles of the contents may be a background color, a font size, a font type, a font's color, etc.

When combined contents become divided, the main contents and the sub-contents are separated into different contents regions (e.g., different memos). Examples for dividing contents are described in detail below.

The contents editing program 115 includes one or more software components for combining defined main contents with defined sub-contents into one contents or dividing one contents into a plurality of contents according to the input of the user. The contents editing program 115 may change a style of the combined or divided contents. For example, the contents editing program 115 changes a style of combined sub-contents to a style of the main contents when combining the contents. In addition, the contents editing program 115 may restore a style of divided contents to its own original style when dividing combined contents.

In addition, as the contents editing program 115 manages style information while being classified according to contents, it may record style change information whenever a style of the contents is changed. The program 115 may further sense touch input of the user and may copy previously selected contents. For example, when a specific gesture (e.g., flicking, drag, etc.) is sensed to contents selected by the user, program 115 may copy and output the selected contents. Program 115 may further sense touch input of the user and may gather a plurality of contents on any one place (described later in connection with FIGS. 14A and 14B).

For example, when main contents which are a criterion of a gathering position of contents and contents to be gathered are selected by the user, the contents editing program 115 may gather the selected contents around the main contents. Also, when input of the user is sensed to the gathered contents, the contents editing program 115 may move the selected contents to an original position and may cancel a gathering function for the contents.

The style analysis program 116 includes at least one or more software components for determining style information of the defined main contents and the defined sub-contents according to a user's input Here, the style analysis program 116 may determine change records of contents, such as a reproduction speed, a screen output size, the number of reproduction, a background color, a font size, a font type, a font's color, etc.

The application program 117 includes a software component for at least one application program installed in the electronic device 100.

The processor unit 120 may include at least one processor 122 and an interface 124. Processor 122 and interface 124 may be integrated in at least one Integrated Circuit (IC) or may be separately configured.

The interface 124 plays a role of a memory interface in controlling accesses by the processor 122 to the memory 110. Interface 124 also plays a role of a peripheral interface in controlling connection between an input and output peripheral of the electronic device 100 and the processor 122.

The processor 122 provides a contents editing function using at least one software program. To this end, the processor 122 executes at least one program stored in the memory 110 and provides a contents editing function corresponding to the corresponding program. For example, the processor 122 may include an editing processor for combining a plurality of contents into one contents or dividing one contents into a plurality of contents. That is, a contents editing process of the electronic device 100 may be performed using software like the programs stored in the memory 110 or hardware like the editing processor.

The audio processing unit 130 provides an audio interface between the user and the electronic device 100 through a speaker 131 and a microphone 132.

The communication system 140 performs a communication function for voice and data communication of the electronic device 100. Communication system 140 may be classified into a plurality of sub-communication modules which support different communication networks. For example, the communication networks may include, but are not limited to, a Global System for Mobile communication (GSM) network, an Enhanced Data GSM Environment (EDGE) network, a Code Division Multiple Access (CDMA) network, a W-CDMA network, a Long Term Evolution (LTE) network, an Orthogonal Frequency Division Multiple Access (OFDMA) network, a wireless Local Area Network (LAN), a Bluetooth network, a Near Field Communication (NFC) network, etc.

The I/O controller 150 provides an interface between an I/O device such as the touch screen 160 or the input device 170 and the interface 124.

The touch screen 160 is an I/O device for outputting and inputting information. The touch screen 160 includes a touch input unit 161 and a display unit 162.

The touch input unit 161 provides touch information sensed through a touch panel to the processor unit 120 through the I/O controller 150. At this time, the touch input unit 161 changes the touch information to a command structure such as a touch_down structure, a touch_move structure, and a touch_up structure, and provides the changed touch information to the processor unit 120. The touch input unit 161 provides a command for editing contents to the processor unit 120 according to exemplary embodiments of the present invention.

The display unit 162 displays state information of the electronic device 100, characters input by the user, moving pictures, still pictures, etc. For example, the display unit 162 displays contents corresponding to an edited target, edited contents, and an editing process of the contents.

The input device 170 provides an input data generated by selection of the user to the processor unit 120 through the I/O controller 150. In one example, the input device 170 includes only a control button for controlling the electronic device 100. For another example, the input device 170 may be a keypad for receiving an input data from the user. The input device 170 provides a command for editing contents to the processor unit 120 according to exemplary embodiments of the present invention.

Although not shown in FIG. 1, the electronic device 100 may further include components for providing additional functions, such as a camera module for image or video capture, a broadcasting receiving module for receiving broadcasting, a digital sound source reproducing module like an MP3 module, a short-range wireless communication module for performing short-range wireless communication, a proximity sensor module for performing proximity sensing, and software for operation of the components.

Figure 2:
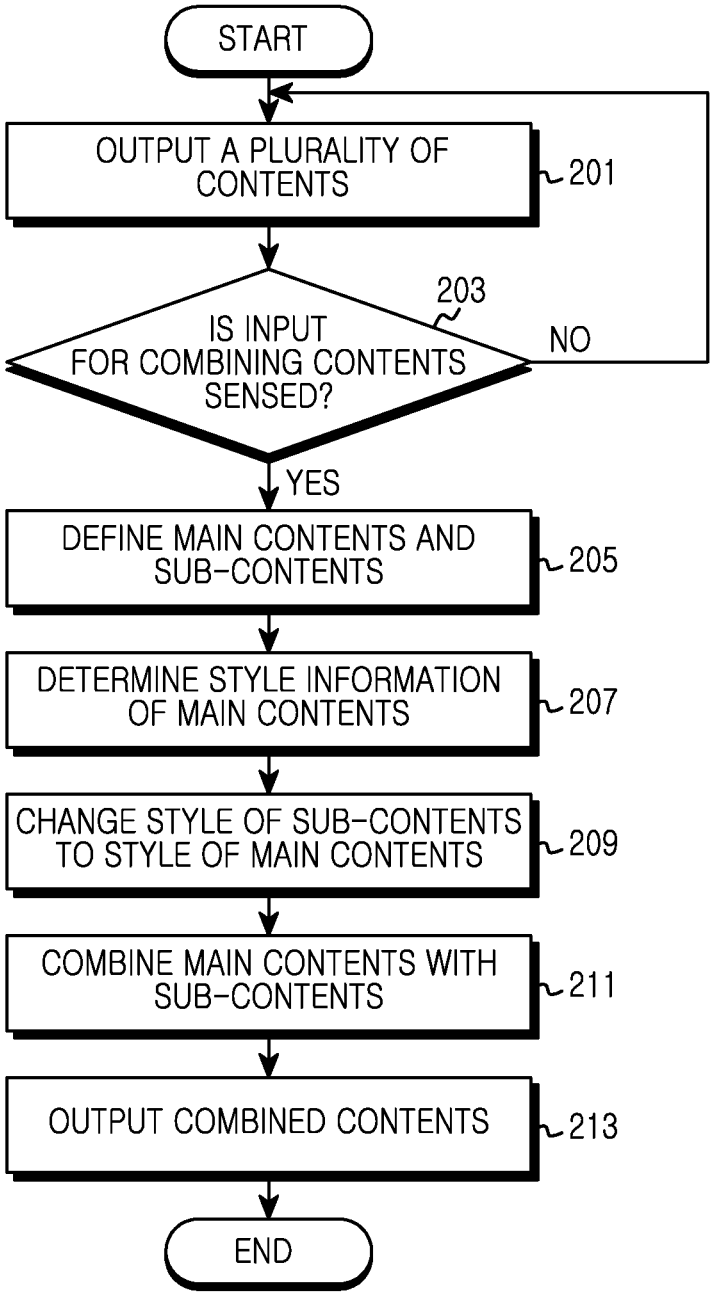
FIG. 2 is a flowchart illustrating a process of editing contents in an electronic device according to an exemplary embodiment of the present invention.

FIG. 2 is a flowchart illustrating a process of editing contents in an electronic device according to an exemplary embodiment of the present invention. The exemplary process of editing the contents will be described with reference to a process of combining a plurality of contents into one contents.

First, device 100 (hereafter referred to as "the device") outputs a plurality of contents in step 201. Here, the device may output contents of the same type or different types.

The method then proceeds to step 203 and determines whether input of a user for combining contents is sensed. If NO, normal functionality is performed. If YES, the method proceeds to step 205 and defines main contents and sub-contents from contents to be combined. Here, the device may analyze the user's input gesture and based thereon, define the main contents and the sub-contents from the contents to be combined. When the contents are combined, a style of the sub-contents is changed to a style of the main contents. For example, when the contents are multimedia data items (e.g., jpg data items, mp3 data items, avi data items, mmf data items, etc.), styles of the contents may be a reproduction speed, a screen output size, the number of reproduction, etc. When the contents are text data items (e.g., pdf data items, doc data items, hwp data items, txt data items, etc.), styles of the contents may be a background color, a font size, a font type, a font's color, etc.

The method proceeds to step 207 and determines style information of the main contents. Next, at step 209, a style of the sub-contents is changed using the style information of the main contents. At this time, the electronic device stores the changed style information of the sub-contents. When the sub-contents are subsequently divided, the changed style of the sub-contents is applied to an original style of the sub-contents when the sub-contents are divided.

The device proceeds to step 211 and combines the main contents with the sub-contents. At step 213, the combined contents are output on a display unit.

In step 205, the electronic device may sense contents movement using a finger, an electronic pen, etc., and may classify the main contents among the contents to be combined.

For example, assuming that the user overlaps different contents regions using touch movement and performs a contents combining process, the device may define contents, which are not moved, as the main contents and define contents moved to be overlapped as the sub-contents, among the contents to be combined.

In addition, the electronic device may define contents which are moved in a state where the contents are touched by an electronic pen as the main contents and may define contents overlapped with the main contents as the sub-contents.

In addition, the electronic device may identify a type of the overlapped contents and may define the main contents and the sub-contents automatically according to the predefined pattern. This means that the electronic device defines contents to be added or combined to other contents as the sub-contents among the plurality of overlapped contents. When multimedia data items and text data items are overlapped, the text data items may be the main contents and the multimedia contents as an attached file may be combined with the text data items.

Figure 3:
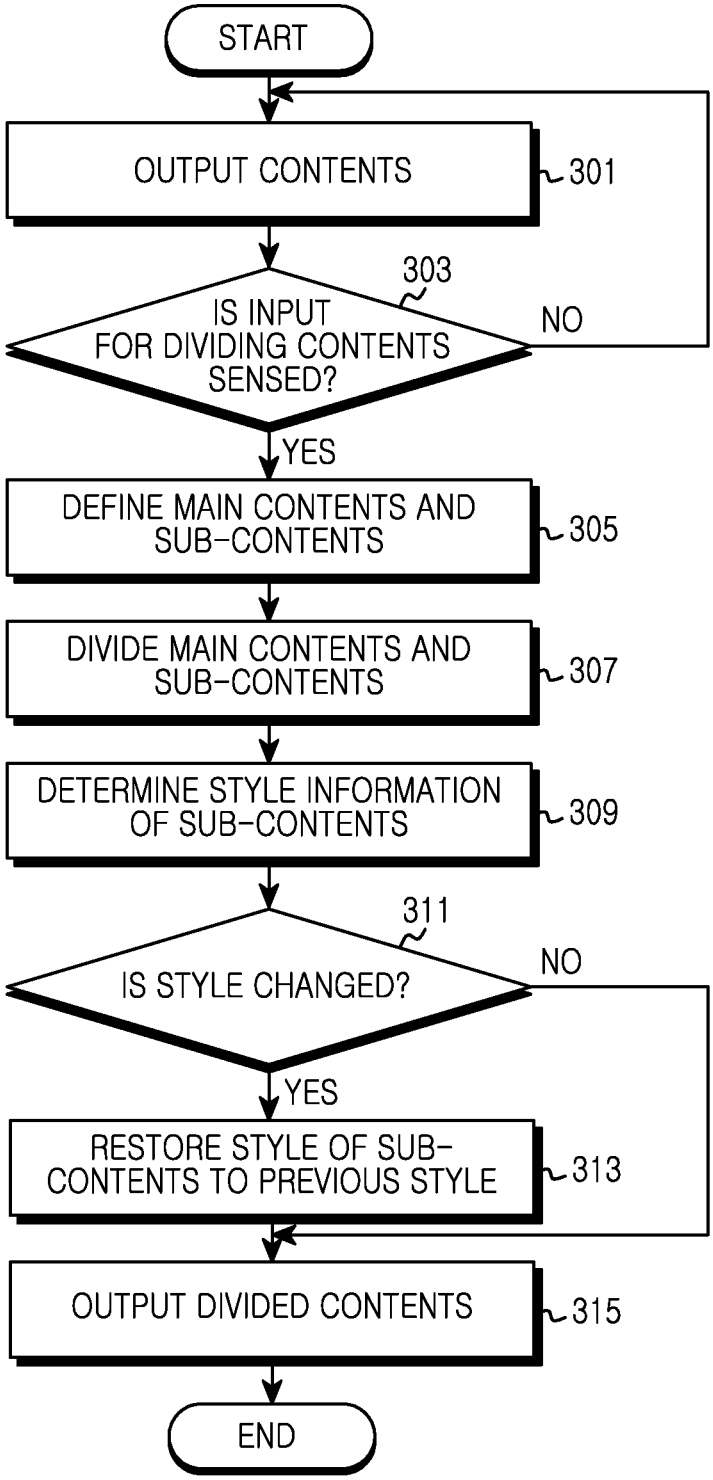
FIG. 3 is a flowchart illustrating a process of editing contents in an electronic device according to another exemplary embodiment of the present invention.

FIG. 3 is a flowchart illustrating a process of editing contents in an electronic device according to another exemplary embodiment of the present invention. The exemplary process of editing the contents will be described with reference to a process of dividing one contents into a plurality of contents.

The device outputs contents in step 301 and then determines whether input of a user for dividing contents is sensed (303). If so, the method proceeds to step 305 and defines main contents and sub-contents from contents to be divided, based on a user's input gesture. Next, at step 307 the main contents and the sub-contents are divided. At step 309, style information of the sub-contents is determined. Here, the style information of the sub-contents means a style change history of the sub-contents.

The electronic device proceeds to step 311 and determines whether a style of the sub-contents has been changed. If so, at step 313 the style of the sub-contents is restored to a previous style. The device proceeds to step 315 and outputs the divided contents.

If at step 311, no style change is detected, the divided sub-contents are output as is at step 315. Thereafter, the algorithm ends.

Figure 4:
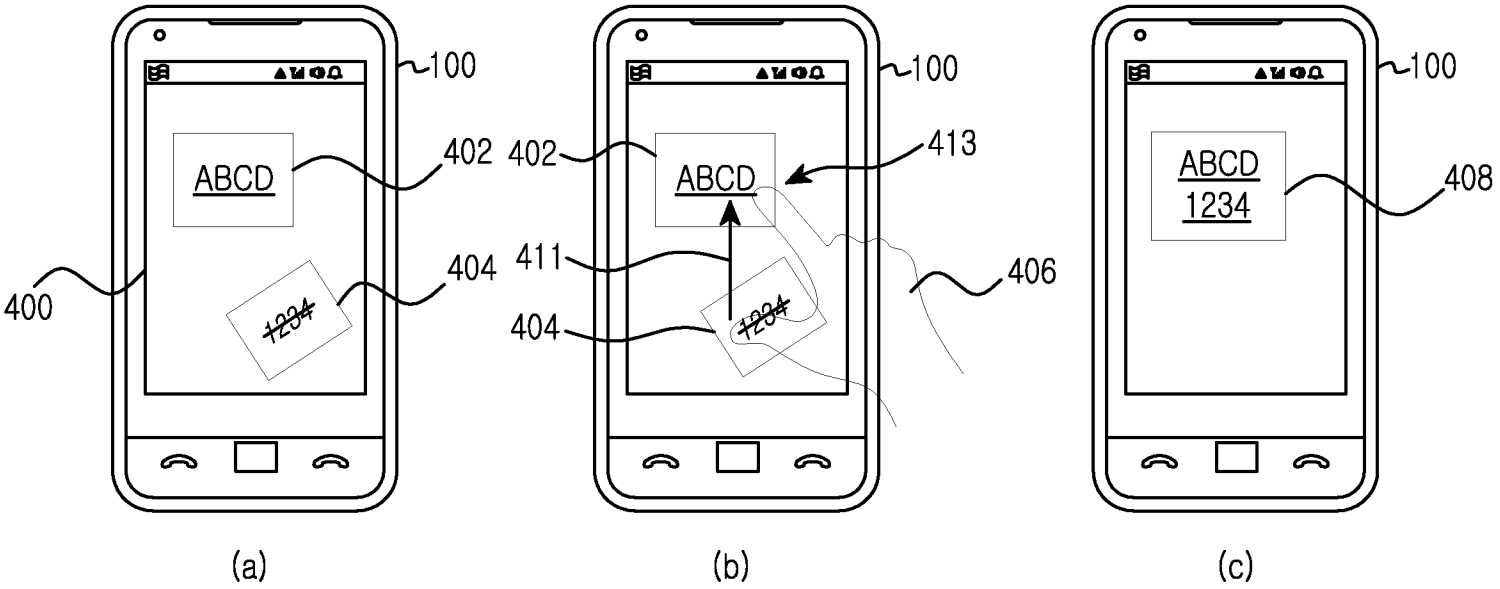
FIG. 4 illustrates a process of combining contents in an electronic device according to an exemplary embodiment of the present invention.

FIG. 4 illustrates a process of combining contents in an electronic device according to an exemplary embodiment of the present invention. As shown in screen state (a), device 100 displays a plurality of contents in different contents regions. It is assumed here that a contents combining mode in accordance with the invention is activated, which enables a user of device 100 to combine the contents of different contents regions for display within a single, combined contents region. The contents combining mode is referred to hereafter as a "common style mode" in accordance with the invention, as it enables the combined contents to be automatically displayed with a common style in the combined contents region. The mode may be activated by default, by a user selection in a settings menu, or by a prescribed input command. (Note that if the user does not currently desire a common style for combined contents, the mode may be deactivated via a suitable input command.) In the following description, memos will be used as examples of contents regions; however, the method can be equally applied to other types of contents regions.

As shown in process state (a), a screen 400 outputs two memos 402 and 404. Memos 402 and 404 include texts written by different styles. In more detail, one memo 402 has a style in which a single underline is added to a text ABCD, and the other memo 404 has a style in which a strike-out is added to a tilted number 1234. These styles are of course merely exemplary; many different styles can be implemented and selected by a user.

Referring to state (b), the user of the electronic device generates input 406 for combining the contents of output memos 402 and 404 into a single memo 408 shown in state (c). Device 100 senses the user input 406 and determines, based on an attribute of the input 406, which of the memos 402, 404 is to be designated a main memo and which is to be designated a sub-memo. Device 100 then designates a style of the combined memo 408 which combines the contents of the main memo, i.e., memo 402 in this example, and the contents of sub-memo 404, with the style of the main memo 402.

The determination as to whether a touch input gesture corresponds to a memo combining operation, and if so, how to designate memos as main or sub memos, can be made in accordance with certain criteria in a number of predetermined ways. For example, the device may detect a memo combining command when the user input 406 moves 411 at least a predetermined portion of one memo so as to overlap the other memo, whether or not a touch 413 on the non-moving memo is detected. The device may define a memo that is not moved by the touch input 406 as the main memo, and may define a memo that is moved to be overlapped, as the sub-memo. In an alternative method, if one memo is initially touched 413, then any subsequent touch contact causing motion and overlap with that memo within a predetermined time duration, results in the designation of the firstly touched memo as the main memo.

State (c) exemplifies a state in which the process has combined the two memos 402 and 404 into one memo 408 according to the input of the user. Here, to combine the memos is to include contents of the sub-memo in contents of the main memo, so that the main memo becomes a combined memo. As shown the screen of (c), the number 1234 of the former sub-memo 404 is included in a partial region of the main memo including the text ABCD. The sub-memo 404 had the style in which strike-out is added to the number 1234. However, the sub-memo has the style of the main memo in the combined memo 408 and has a single underline instead of the strike-out.

Figure 5:
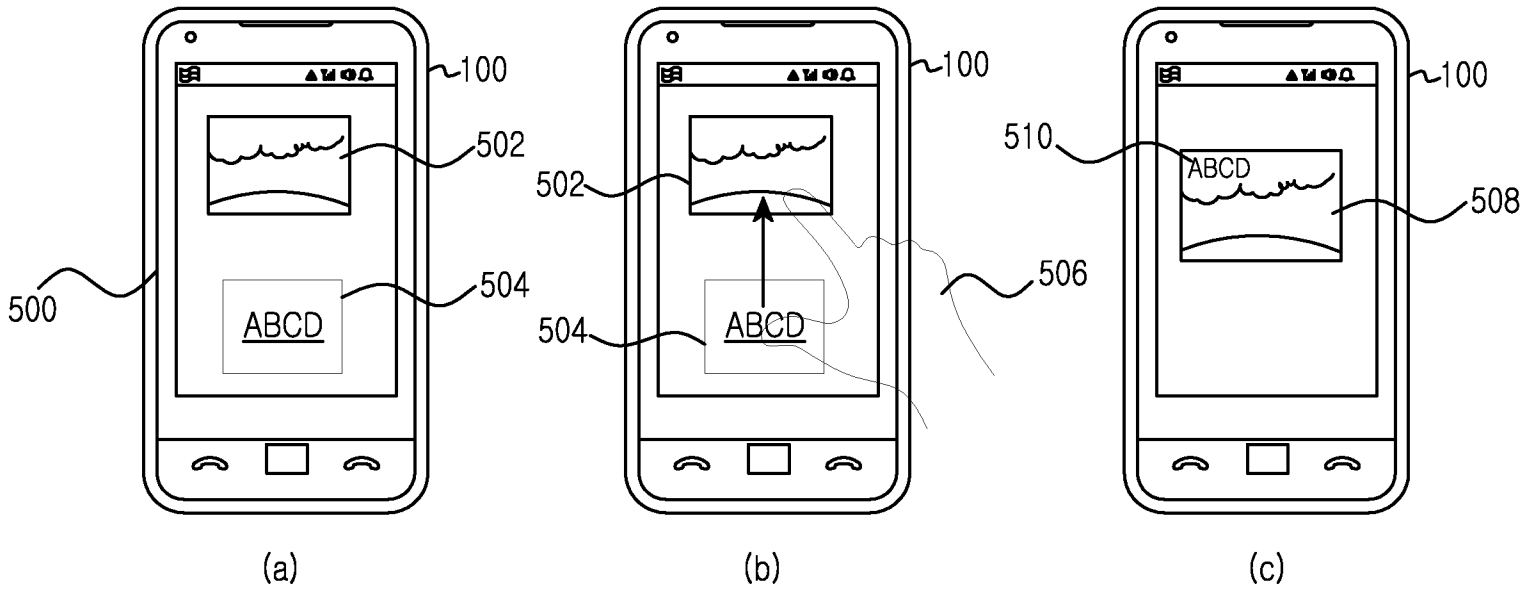
FIG. 5 illustrates a process of combining contents in an electronic device according to another exemplary embodiment of the present invention.

FIG. 5 illustrates a process of combining contents in an electronic device according to another exemplary embodiment of the present invention. The process of combining the contents shown in FIG. 5 is a process of combining contents of different types.

As illustrated in screen state (a), the device outputs contents of different types. For instance, screen 500 displays an image (e.g. thumbnail) 502 as a first contents region, and a memo 504 containing text contents as a second contents region. At this point, it is assumed that the device has entered a contents combining mode (discussed earlier). In state (b), the user generates input 506 for combining the image 502 with the memo 504 into one contents 508 as shown in state (c). Input 506 may be generated in any of the same manners as described above for input 406 of FIG. 4. The device senses the input 506 and determines based on the input 506 attributes which contents are main contents are sub-contents. For example, the device may determine contents regions that are overlapped due to touch movement and may classify the main contents and the sub-contents when the overlapping is detected. When the sub-contents are a memo and the main contents are an image, the contents of the memo are added to a partial region of the image. On the other hand, when the sub-contents are an image and the main contents are a memo, the combining process can add the image to a partial region of a memo. (Alternatively, if a function is predesignated as a superposition, text or a first image of a first contents region is superimposed with a second image of a second contents region, where the superposition can result in text displayed in an entire region, with an image superposed as a background image). In either case, the partial region may be predetermined, or, may correspond to a point at which the user releases touch contact.

Figure 6:
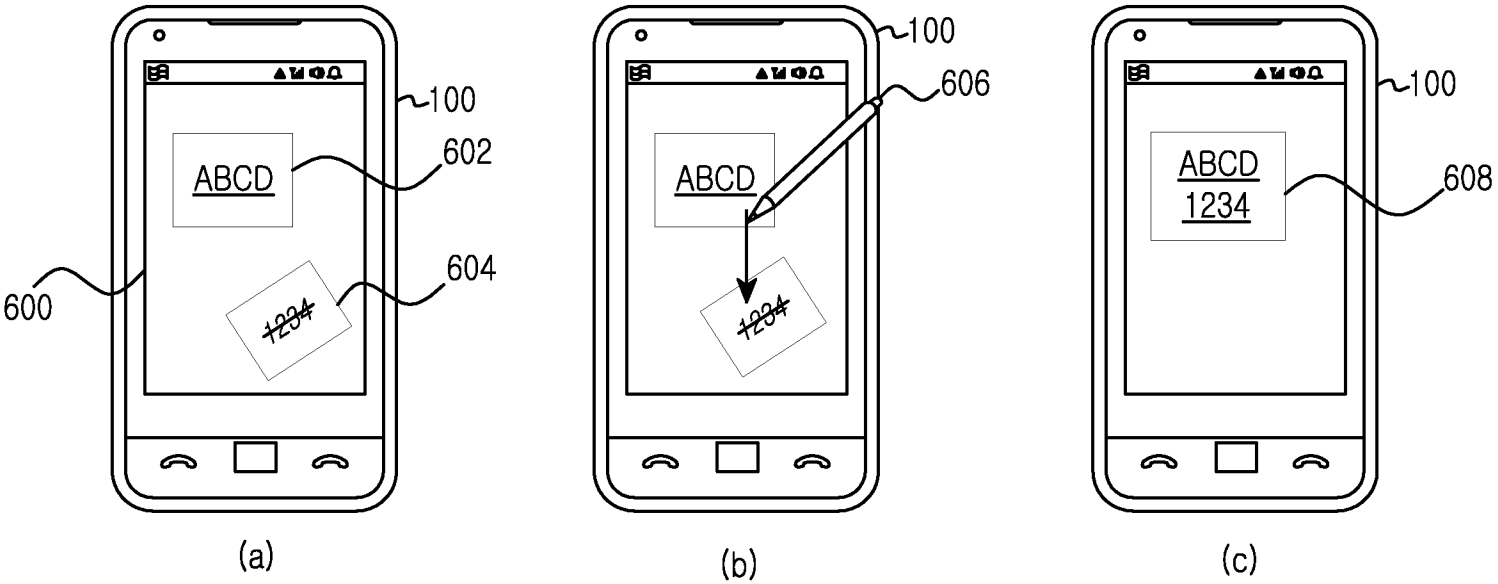
FIG. 6 illustrates a process of combining contents in an electronic device according to another exemplary embodiment of the present invention.

As exemplified in state (c), upon detecting the input 506, the process adds contents of the memo 504 to a partial region of the image 502. This results in a combined contents region 510 containing an image component 508 and a text component 510, where, based on a pre-designation, the text in the combined image can be displayed in the same format as in the sub-memo 504, or it can be displayed differently in a preset manner. FIG. 6 illustrates a process of combining contents in an electronic device according to another exemplary embodiment of the present invention.

Referring to screen state (a), the device outputs a plurality of contents. It is assumed that a user of the electronic device wants to combine the output contents (i.e., the device is in a contents combining mode, discussed above). In the example, the device outputs a screen 600 displaying two memos 602 and 604. The output memos 602 and 604 include texts written by different styles. In more detail, the one memo 602 has a style in which a single underline is added to a text ABCD, and the another memo 604 has a style in which a strike-out is added to a number 1234.

Referring to screen state (b), the user of the electronic device generates input 606 for combining the output memos Input 606 is generated in this example using an electronic pen to combine the output memos into one memo. The electronic pen may be a pen recognized by device 100 differently than a passive stylus.

The device may sense the input 606 of the electronic pen and determine a main memo and a sub-memo based on attributes of the gesture of input 606. Here, the device generates a combined memo 608, as shown in state (c), containing the contents of the main memo 606 and sub menu 604, where the style of the combined memo matches the style of the main memo.

As illustrated in the example of screen state (b), when the device determines that a memo selected (e.g. initially touched) by the electronic pen is moved and overlapped with another memo, it may define the memo selected by the electronic pen as the main memo and may define another memo as the sub-memo.

Referring to state (c), the device combines the two memos into one memo 608 according to input of the electronic pen. Here, to combine the memos is to include contents of the sub-memo in contents of the main memo, which becomes the combined memo. In the example of (c), the device creates the combined memo by including the number 1234 of the sub-memo in a partial region of the main memo including the text ABCD. The sub-memo 604 has the style in which the strike-out is added to the number 1234. However, the sub-memo contents has the style of the main memo in the contents combining process and has a single underline instead of the strike-out.

Figure 7:
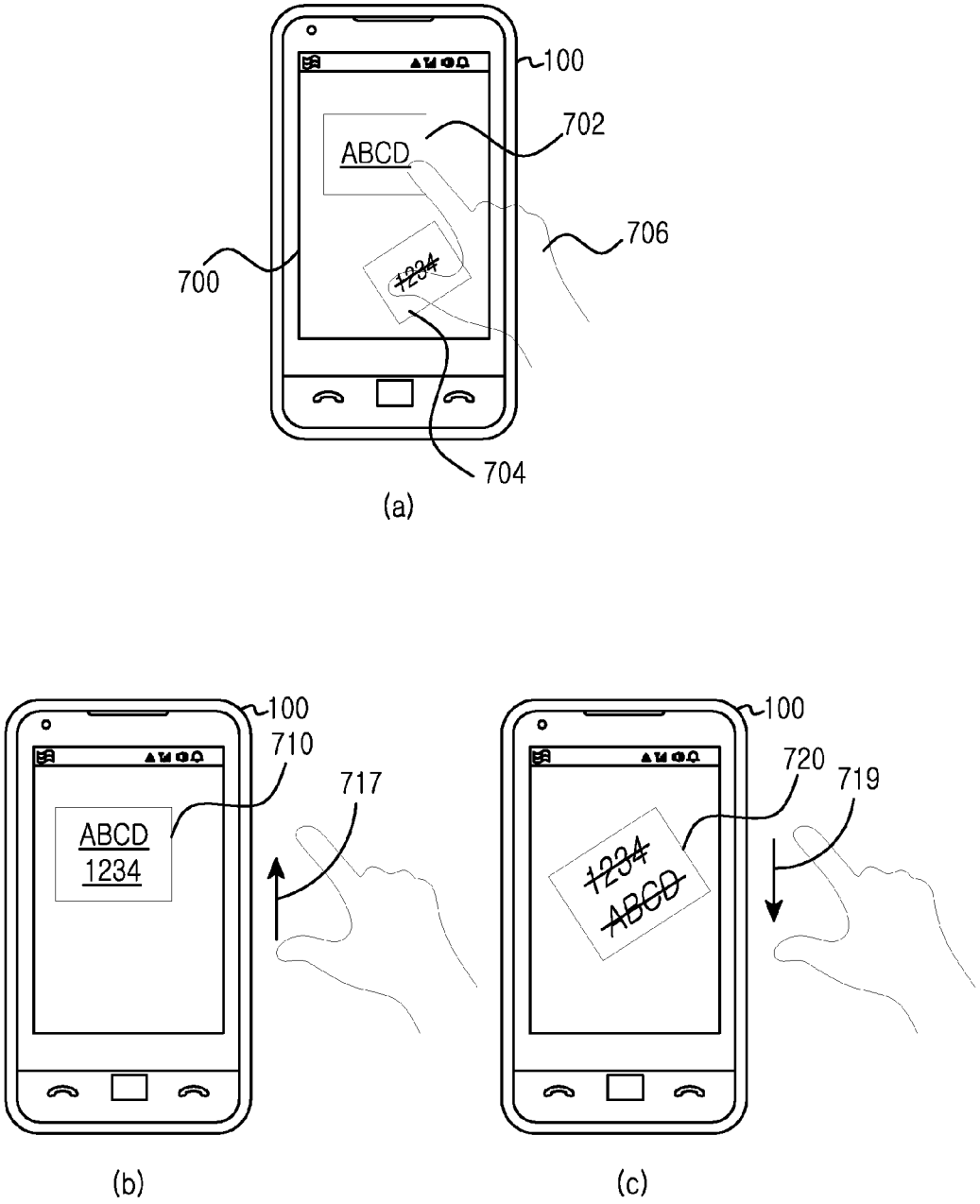
FIG. 7 illustrates methods of combining contents in accordance with exemplary embodiments of the present invention.

FIG. 7 illustrates methods of combining contents in accordance with exemplary embodiments of the present invention.

State (a) shows a plurality of contents 702 and 704 output by device 100, and is the same as screen (b) of FIG. 4; thus redundant description thereof is omitted In the embodiment, if touch input 706 is the same as input 406 of FIG. 4, i.e., where the lower touch point on the lower memo 704 moves in the upward direction 717, the result is screen state (b) with combined memo 710, i.e., the same as memo 408. In this case, the upper memo 702 is designated the main memo, and its style is retained in the combined memo.

However, if the input 706 is instead in the downward direction beginning from a touch on memo 702, as illustrated by the arrow 719 in state (c), then the upper memo 702 (which is caused to move) is designated as the sub memo, and the "target memo", i.e., memo 704, is designated the main memo. In this case, the resulting combined memo 720 has the style of the main memo 704.

Figure 8:
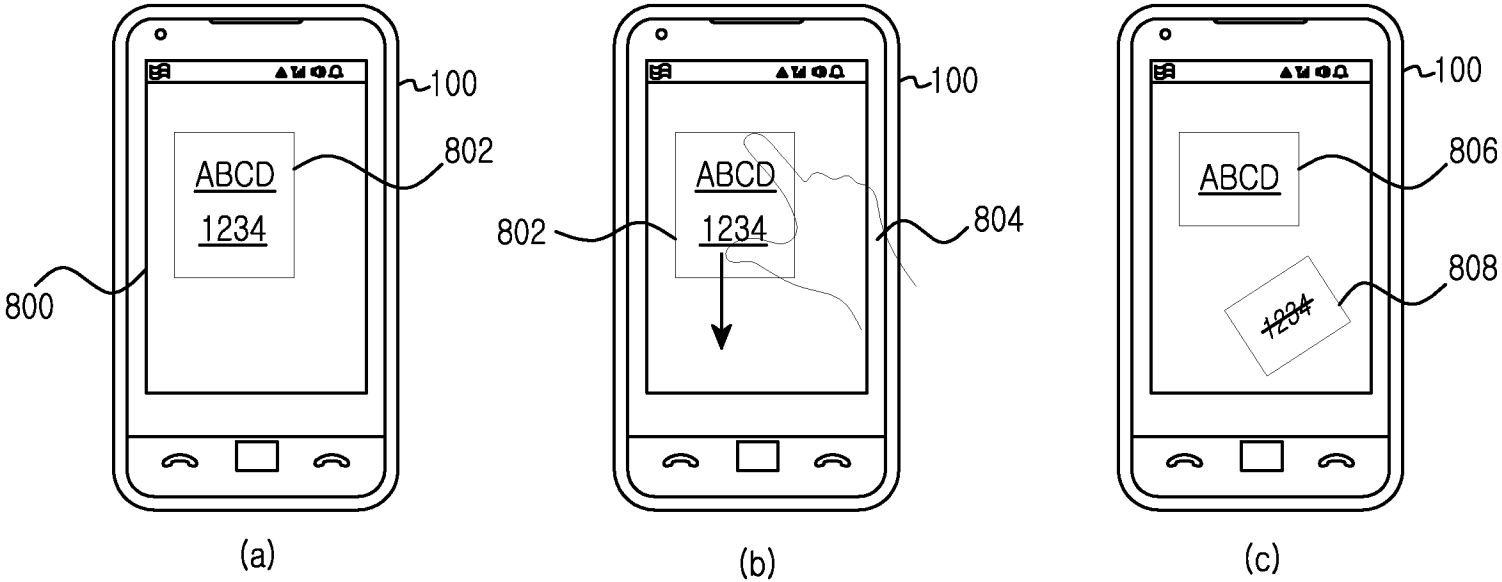
FIG. 8 illustrates a process of dividing contents in an electronic device according to another embodiment of the present invention.

FIG. 8 illustrates a process of dividing contents in an electronic device according to another embodiment of the present invention.

Referring to screen state (a), device 100 outputs a screen 800 for outputting contents in a memo 802. It is assumed that a user wants to divide the output contents of memo 802, and that device 100 is set up in a mode enabling such division. In this example, the contents to be divided are contents that have previously been combined from a plurality of memos through a contents combining process as described above. Alternatively, the plurality of contents to be divided was all originally generated in memo 802, and are displayed in different regions, e.g., different rows, of memo 802.

Referring to screen state (b), the user generates input 804 for dividing memo 802 into two or more output memos. The device senses the input 804 and determines a main memo and a sub-memo from the original memo 802. Here, the main memo and the sub-memo mean regions separated from the contents of memo 802.

For example, the user of the electronic device may classify a region to be divided from memo 802, may divide the memo 802 contents by moving the classified region, and may generate the divided regions as respective divided memos.

Referring to screen state (c), the device may divide the one memo 802 into two memos 806 and 808 according to the input gesture of the user. An example of an input gesture recognized to cause division is a two touch point pinch-out as shown. In this case, one touch point is made on a first contents, a second touch point is made on a second contents, and the second touch point is dragged outside of the contents region as illustrated by the downward pointing arrow. At this time, the electronic device determines style information of the divided memos and restores a determined style of a divided memo to a previous style, if one existed for contents of a previously combined sub-memo whose contents underwent a style change when combined. In the example of state (c), a single underline applied to a number 1234 is changed to a strike-out, and a memo 808 with the style in which the strike-out is applied to a number 1234 is output.

Note that in the dividing operations of FIG. 8, the output memo 806 can be thought of as the same original memo 802, minus the contents that were extracted out to create the new memo 808.

Figure 9:
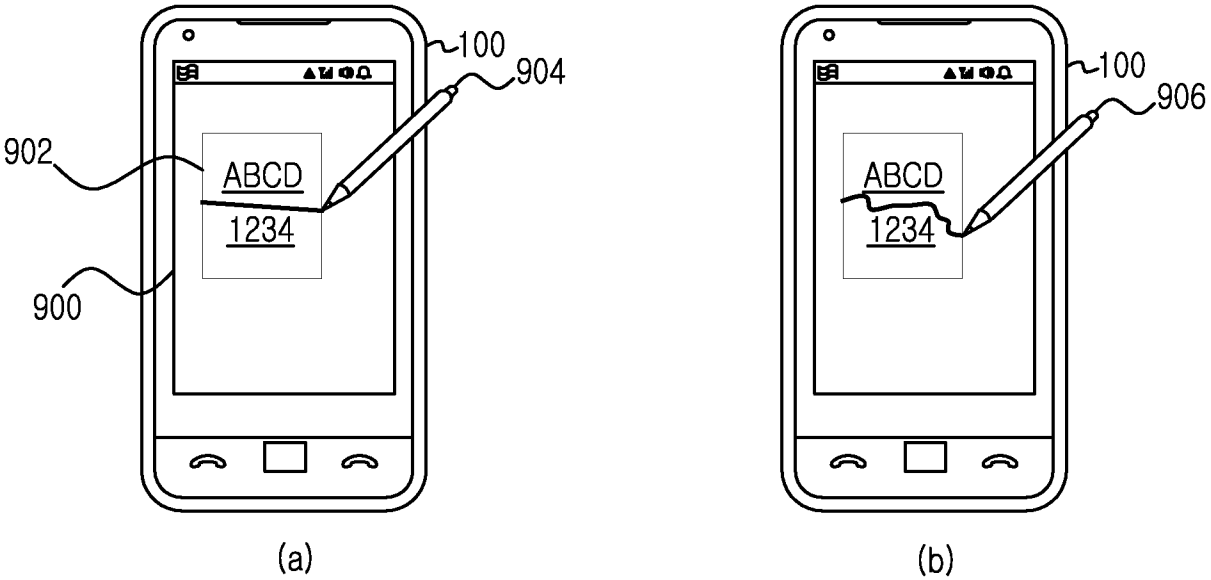
FIG. 9 illustrates a process of setting a region of contents to be divided in an electronic device according to another embodiment of the present invention.

FIG. 9 illustrates a process of setting a region of contents to be divided in an electronic device according to another embodiment of the present invention. As shown in example screen states (a) and (b), device 100 senses a dividing input command as a touch input 904, which may be a user's finger touch input or an input of an electronic pen or a stylus. The input 904 sets regions of contents memo 902 to be divided (i.e., at least one region is to be removed by separation from the memo 902). Here, the device may sense the input 904 corresponding to a straight line shown in state (a) or an input 906 corresponding to an irregular curve shown in state (b). In either case, a region of the contents memo 902 is selected to be separated responsive to the dividing input command of input 904 or 906.

At this time, the electronic device may restore styles of the divided respective contents to previous styles (if applicable) or may restore only a style of contents selected by the user to a previous style.

For example, when the electronic device senses the input for dividing the set region of the contents, it may restore styles of the respective contents to previous styles.

However, when the electronic device senses input for maintaining a first contents and separating only the remaining contents from the set of contents, it may maintain a style of the first contents and may restore only a style of the remaining contents to a previous style. Suitable input commands can be pre-designated for realizing a distinction between the two conditions.

Figure 10:
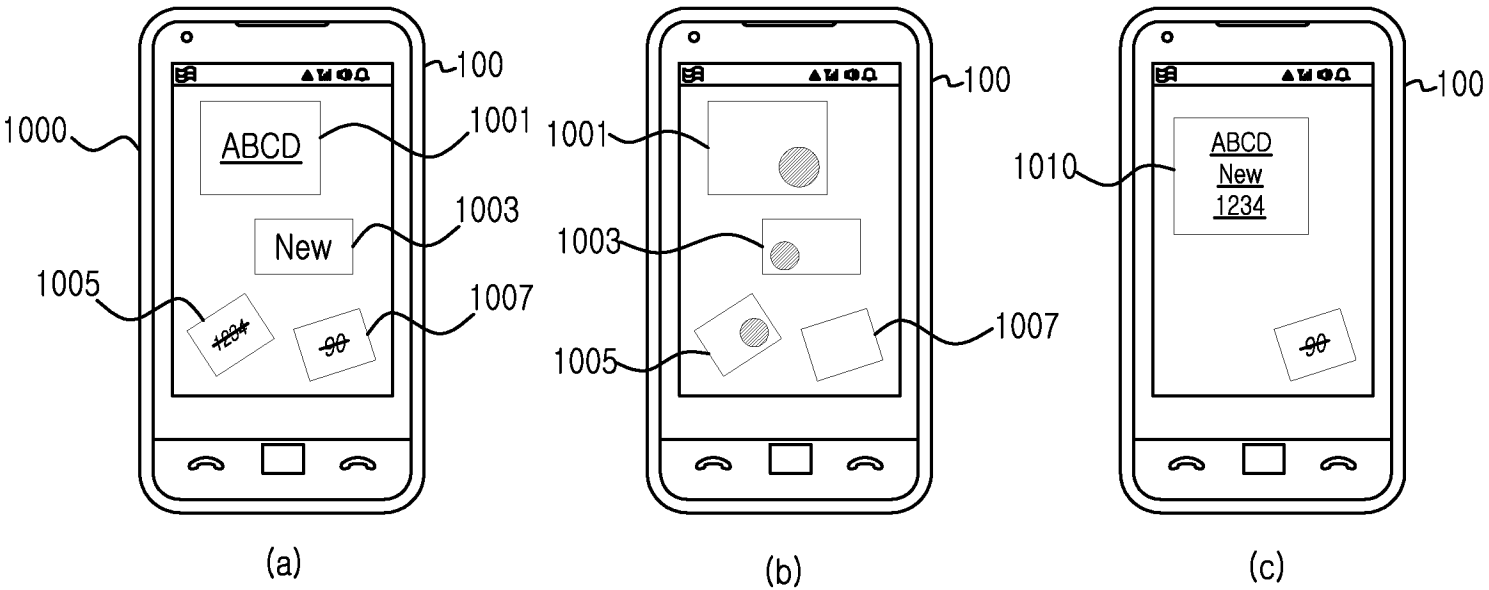
FIG. 10 illustrates a contents combining process in accordance with an embodiment.

FIG. 10 illustrates a process of editing contents in an electronic device according to another exemplary embodiment of the present invention.

Screen states (a) to (c) illustrate a contents combining process. First, as shown in (a), device 100 outputs a screen 1000 containing a plurality of contents of different styles in respective memos 1001, 1003, 1005 and 1007. As depicted in (b), the device senses user inputs (denoted by the shaded circles) for selecting contents to be combined with each other within a combined memo. In the example, the device senses touch input of the contents to be combined, i.e., memos 1001, 1003 and 1005, and determines the contents to be combined responsive to the touch inputs. Alternatively or additionally, the device may sense touch movement such as drag of contents to a region overlapping with another memo, and ascertain contents to be combined with the overlapped memo in this manner.

When touch input on the various memos is sensed, device 100 may define main contents and sub-contents from the contents to be combined. For example, the device may define contents on which the user maintains touch input as main contents. In an example designation, the user taps a plurality of sub-contents and combines the main contents with the sub-contents in a state where touch input on the main contents is maintained.

In another example designation method, the device may define contents whose position is fixed through touch input as main contents. Here, the user selects and moves a plurality of sub-contents and combines the main contents with the sub-contents in a state where he or she fixes the main contents.

In yet another example designation method, the device may define main contents and sub-contents using a touch input sequence. With this approach, the device defines contents touched for the first time by the user as the main contents and combines the main contents with contents that are thereafter continuously touched.

As shown in screen state (c), the device combines the contents selected by the user with each other to form a combined memo 1010. A style of the main contents is applied to memo 1010 with priority over a style of the sub-contents.

Figure 11:
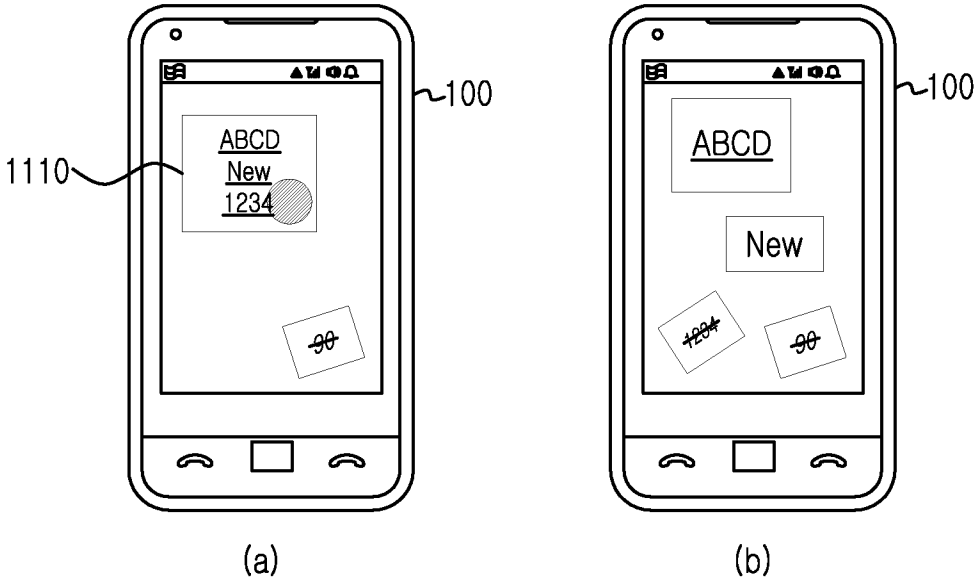
FIG. 11 illustrates a contents dividing process in accordance with an embodiment.

FIG. 11 illustrates a dividing process in accordance with an embodiment. First, as shown in screen state (a), device 100 displays combined contents in a combined contents memo 1110 (akin to memo 1010 of FIG. 10) and senses input of a user (shaded circle) for dividing the contents. In an embodiment, the device has pre-designated a single tap or multi-tap touch within the memo of combined contents as an input recognized for dividing contents into previously separated memos. Alternatively or additionally, an input gesture of flicking the combined contents in a specific direction may be recognized as a dividing command, whereby the contents are divided in the corresponding direction(s).

As shown in screen state (b), the device divides the combined contents responsive to the dividing command. At this time, the electronic device restores style information of the divided contents to style information applied before the contents were combined, if applicable. If the memo 1110 was a memo comprising contents that all originated within that memo (not contents combined from different memos), then a division may be implemented on a region basis, e.g., each row of the memo may be transported to a respective separated memo. In this case, the style of the separated memos can be pre-designated as the same style of the combined memo, or of a different style.

Figure 12:
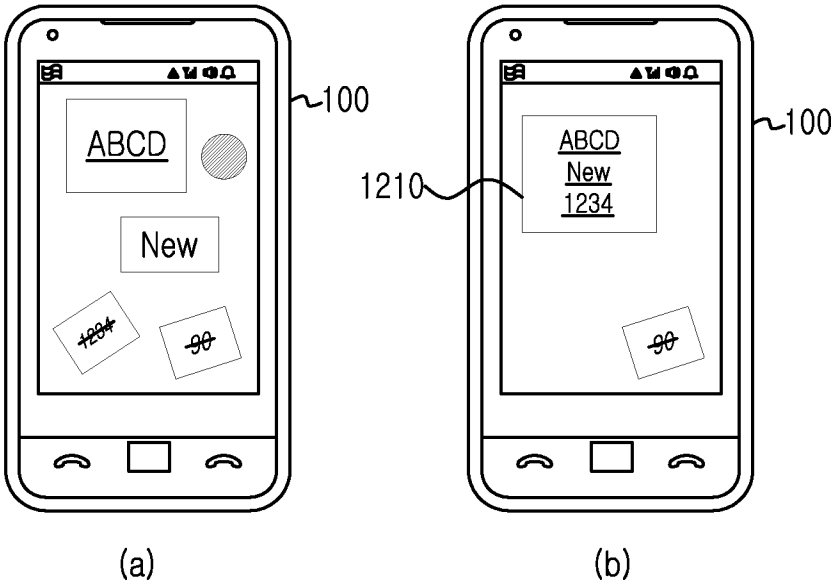
FIG. 12 illustrates a process of arranging divided contents according to an embodiment.

FIG. 12 illustrates a process of arranging a plurality of divided contents in an electronic device according to an embodiment. In the embodiment, a pre-designated input gesture is detected for combining previously divided contents, and the contents are restored to a prior arrangement responsive to the detected gesture.

Example screens illustrate the process. First, as shown in screen state (a), device 100 displays a plurality of divided contents and senses user input (shaded circle applied outside memo regions) for arranging the contents. Here, the device uses input for touching a specific region of an output screen as the user input for arranging the contents. Alternatively, the electronic device may sense user input for selecting the divided contents individually and may arrange the corresponding contents.

As shown in screen state (b), the device performs a process of arranging the divided contents. The process of the arranging the divided contents may be a process of combining the divided contents again. In addition, the process of the arranging the divided contents may be a process of rearranging the divided contents on one point. As shown in screen (b), sensing the input of the user for touching the specific region, the electronic device restores the divided contents shown in (b) of FIG. 11 to contents before being divided shown in (c) of FIG. 10.

Figure 13:
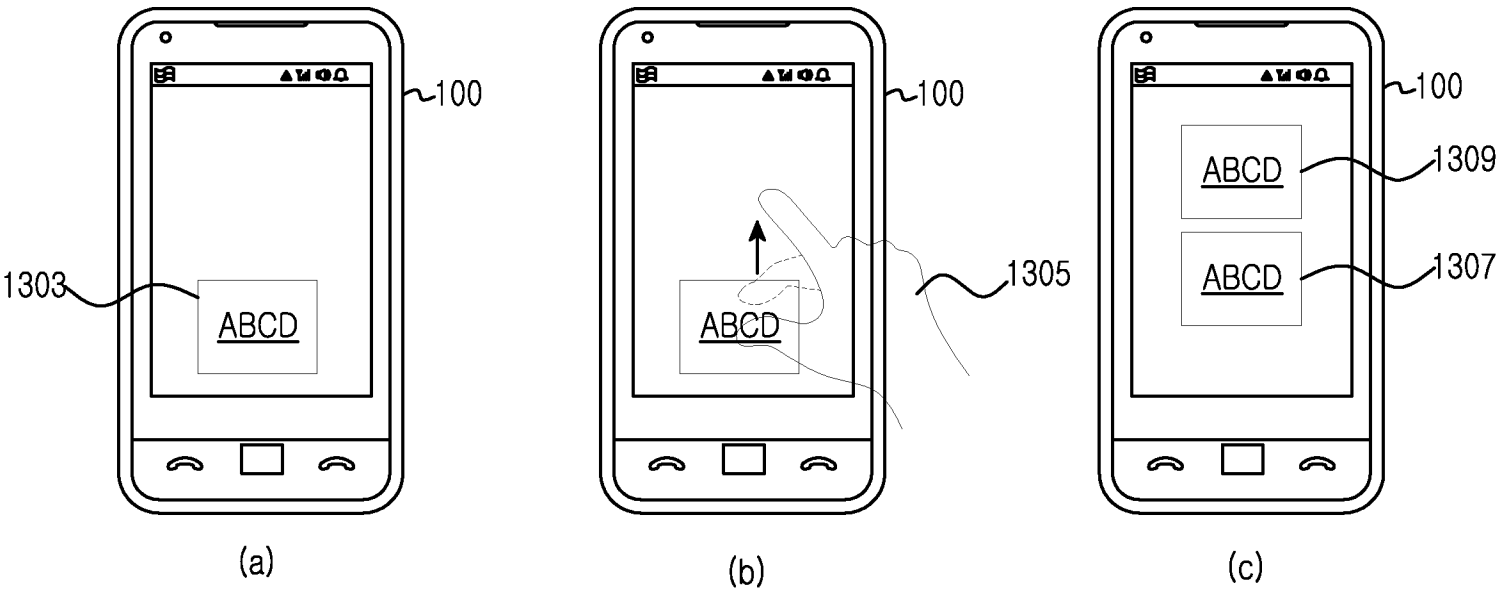
FIG. 13 illustrates a process of copying contents in an electronic device according to an embodiment.

FIG. 13 illustrates a process of copying contents in an electronic device according to an exemplary embodiment of the present invention. In the process, device 100 senses a user's touch input and generates a plurality of the same contents as output contents.

Example screens illustrate the process. First, as shown in screen state (a) the device displays a contents memo 1303. The device thereafter determines that contents are to be copied in response to sensing a predetermined user input 1305 for copying the contents.

For example, the user may long press the contents to be copied with a finger or stylus to thereby select the contents to be copied according to a preset long press designation for this function. Sensing the above-described operation of the user, the electronic device may apply specific effects (e.g., shading, an effect applied to borders, etc.) to the selected contents and may display that a copy function for the contents is activated.

Alternatively or additionally, the user of the electronic device may copy the contents using a flicking operation for the selected contents. That is, the user may flick the contents with a finger or stylus in a state where he or she selects the contents with another finger. Sensing the above-described operation, the electronic device may copy and output the same contents as the selected contents in a flicking direction. As shown in screen state (b), the user applies a flicking gesture to the touch screen to flick the contents in a state where he or she maintains touch input with his or her thumb within the memo region, which results in the contents being copied as shown in screen state (c). That is, sensing the user input for copying the contents, device 100 copies and outputs the same contents 1309 as the contents 1307 selected in (b).

In the example shown, the user copies the contents with one hand. However, in accordance with another exemplary embodiment, the device may copy contents by sensing inputs from two different input means. The user may select contents to be copied with one hand (e.g., a left hand or an electronic pen), flick the contents with a finger of another hand touched at a different point, (e.g., a right hand), to thereby copy the contents.

Figure 14A:
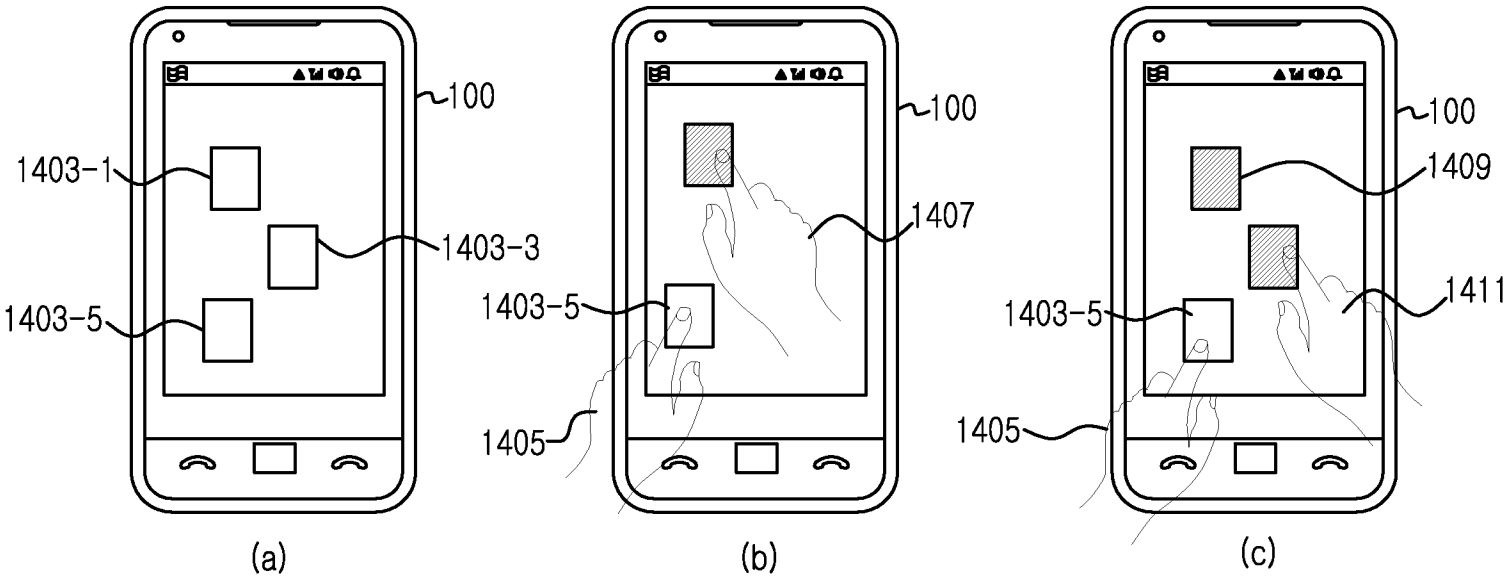
FIG. 14A illustrates an initial phase of a process of gathering contents in an electronic device according to an embodiment.
Figure 14B:
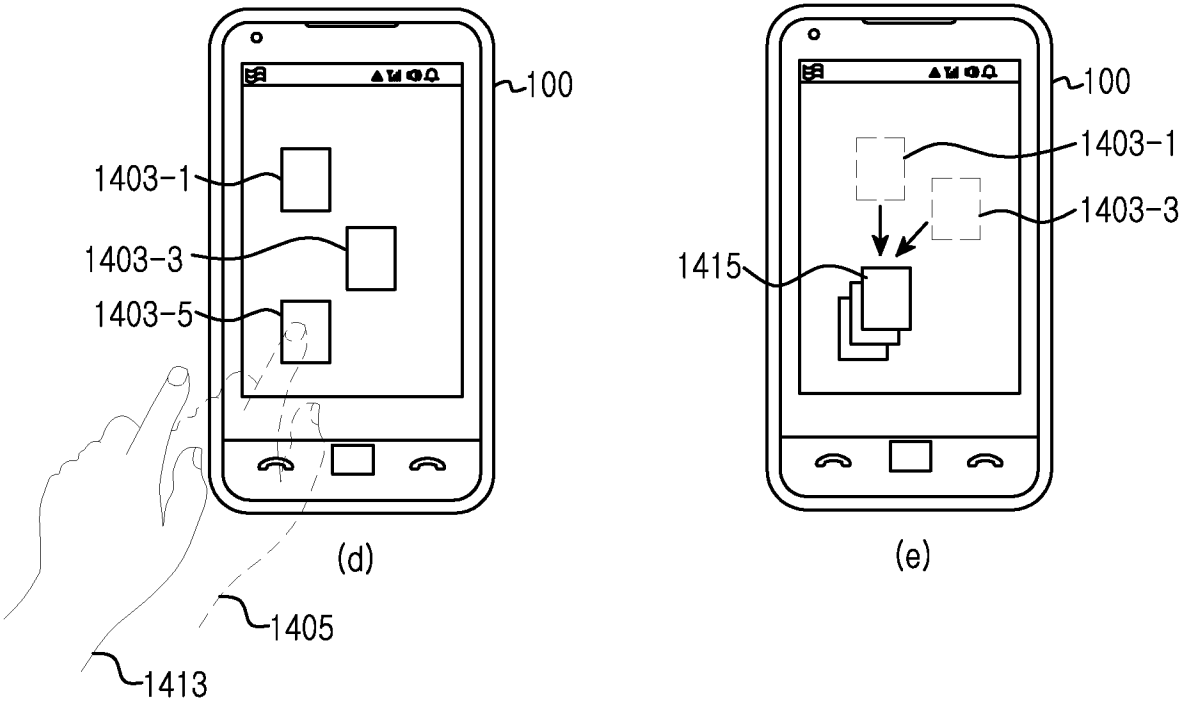
FIG. 14B illustrates a final phase of the process of FIG. 14A.

FIGS. 14A and 14B illustrates an example process of selecting contents to be gathered (combined) in an electronic device according to an embodiment of the present invention. In this process, the device senses a user's touch input and selects contents for rearranging a plurality of output contents around main contents. Screen examples (a) to (e) illustrate the process. First, as shown in screen (a), the device 100 displays a plurality of contents 1403-1, 1403-3, and 1403-5 in respective contents regions. As shown in screens (b) through (e), a series of touch inputs results in the plurality of contents being gathered so as to generate a stacked contents configuration 1415 shown in screen (e). The stacked configuration has overlapping contents regions so as to display small portions of lower lying contents regions, enabling a user to possibly identify the lower regions in the stack.

In one embodiment of the gathering process, a first contents region that is touched first is designated as a main contents region. While the touch is maintained on the first contents region, if the user touches a second contents region, that second contents region is designated as a sub contents region to become stacked around (or arranged around) the first contents region. To illustrate the process, as shown in (b), the device senses a first user input 1405 on a first contents region 1403-5 to designate that region as a main contents region. While touch 1405 is maintained on region 1403-5, second and third touches 1407 and 1411 made by a different finger or stylus are detected on respective regions 1403-1 and 1403-3, whereby the device determines main contents (region 1403-5) and contents to be gathered. Here, main contents refers to a criterion of a position for gathering the contents. As shown in (c), the user may select a plurality of contents in this manner. The device may apply specific effects (e.g., shading 1409, an effect applied to borders, etc.) to highlight contents region selected for the main contents and the selected contents to be gathered, and may display that a gathering function for the contents is activated. Special effects are preferably different for the main contents region than for the sub contents regions.

FIG. 14B illustrates a final phase of the gathering process. As shown in screen (d), when the device senses that the user input 1405 is released, as indicated at 1413, it determines that the selections for gathering are completed. The device then gathers and outputs previously selected contents 1415 around the main contents, as illustrated in (e).

Accordingly, in the embodiment of FIGS. 14A and 14B, divided contents are rearranged on at least one point of an output screen (e.g., a common point of the main contents region.)

Thereafter, upon detection of a suitable pre-designated input command to separate the gathered contents, the device moves only selected contents to an original position and may cancel a gathering function for the contents.

As described above, an electronic device according to exemplary embodiments of the present invention may divide some of multimedia files or may combine different multimedia files with each other. In this process, the electronic device may partition reproduction intervals of one contents and may divide the one contents into different contents.

As described above, the electronic device divides or combines contents such that the user of the electronic device edits the contents easily through his or her touch input.

While input gestures described above are gestures input on a touch screen, gestures performed in the air but in proximity to the display device may be recognized as equivalent input gestures in other embodiments, when suitable detection means for recognizing the same are incorporated within the electronic device 100.

The above-described methods according to the present invention can be implemented in hardware, firmware or as software or computer code that can be stored in a recording medium such as a CD ROM, an RAM, a floppy disk, a hard disk, or a magneto-optical disk or computer code downloaded over a network originally stored on a remote recording medium or a non-transitory machine readable medium and to be stored on a local recording medium, so that the methods described herein can be rendered in such software that is stored on the recording medium using a general purpose computer, or a special processor or in programmable or dedicated hardware, such as an ASIC or FPGA. As would be understood in the art, the computer, the processor, microprocessor controller or the programmable hardware include memory components, e.g., RAM, ROM, Flash, etc. that may store or receive software or computer code that when accessed and executed by the computer, processor or hardware implement the processing methods described herein. In addition, it would be recognized that when a general purpose computer accesses code for implementing the processing shown herein, the execution of the code transforms the general purpose computer into a special purpose computer for executing the processing shown herein.

While the present invention has been particularly shown and described with reference to exemplary embodiments thereof, it will be understood by those skilled in the art that various changes in form and details may be made therein without departing from the spirit and scope of the present invention as defined by the appended claims.

What is claimed is:

1. A method of editing contents in an electronic device, the method comprising:

detecting selection of contents among a plurality of displayed contents;

determining a main content and a sub-content from the selected contents, based on a predetermined input gesture; and combining the sub-content with the main content, wherein a style of the sub-content automatically changed to a style of the main content when the sub-content is combined with the main content.

2. The method of claim 1, further comprising:

detecting an input designating a content division region;

dividing the combined contents according to the content division region; and automatically restoring a style of the divided content to a previous style thereof.

3. The method of claim 2, further comprising rearranging the divided content on at least one point of an output screen.

4. The method of claim 1, wherein the style of the content includes at least one of a reproduction speed of the contents, a screen output size, a number of regeneration, a background color, a font size, a font type, and a font color.

5. The method of claim 1, wherein determining the main contents comprises:

sensing user input on first content of the plurality of contents prior to sensing input on second content of the plurality of contents, wherein the first content is designated as the main content.

6. The method of claim 1, wherein determining the main content and sub content comprises:

ascertaining an attribute of the gesture; and determining a content to be attached or combined to another content based on the attribute, wherein the content to be attached or combined is the sub content, and remaining content are the main content.

7. The method of claim 1, wherein the plurality of contents are each initially displayed in respective content regions; and combining the sub-content with the main content comprises including the sub-content in a partial region of the content region of the main content.

8. The method of claim 1, further comprising generating and outputting a copy of the main content according to sensed touch input of a user after defining the main content.

9. The method of claim 1, further comprising gathering selected contents around at least one content region in an overlapping relationship according to sensed input of a user.

10. An electronic device for editing contents, the device comprising:

at least one processor; and a memory storing at least one program configured to be executable by at least the one processor;

wherein the program includes instructions for detecting selection of contents among a plurality of displayed contents, defining a main content and a sub-content from the selected contents, and combining the sub-content with the main content, wherein a style of the sub-content automatically changed to a style of the main content when the sub-content is combined with the main content.

11. The device of claim 10, wherein the program includes an instruction for detecting an input designating a contents division region, dividing the combined contents according to the content division region, and automatically restoring a style of the divided content to a previous style thereof.

12. The device of claim 11, wherein the program includes an instruction for rearranging the divided content on at least one point of an output screen.

13. The device of claim 10, wherein the style of the content includes at least one of a reproduction speed of the contents, a screen output size, a number of reproduction, a background color, a font size, a font type, and a font color.

14. The device of claim 10, wherein the program includes an instruction for at least one of:

sensing user input on first content of the plurality of contents prior to sensing input on second content of the plurality of contents, wherein the first content is designated as the main content.

15. The device of claim 10, wherein the program includes an instruction for ascertaining an attribute of a gesture, determining content to be attached or combined to another content based on the attribute, wherein the content to be attached or combined is the sub-content and the remaining content are the main contents.

16. The device of claim 10, wherein the plurality of contents are each initially displayed in respective content regions, and combining the sub-content with the main content comprises including the sub-content in a partial region of the content region of the main content.

17. The device of claim 10, wherein the program includes an instruction for generating and outputting a copy of the main content according to sensed touch input of a user after defining the main content.

18. The device of claim 17, wherein the program includes an instruction for gathering selected contents around at least one content region in an overlapping relationship according to sensed input of a user.

19. The device of claim 10 wherein the device includes a touch screen, and a predetermined input gesture is a gesture touching the touch screen.

20. A non-transient computer-readable medium storing one or more programs comprising instructions that, when executed by a processor of an electronic device, cause the electronic device to perform the method of claim 1.

* * * * *